US006300916B1

(12) United States Patent
Diez

(10) Patent No.: US 6,300,916 B1
(45) **Date of Patent: *Oct. 9, 2001**

(54) TRANSMISSION DEVICE WITH OMNIDIRECTIONAL ANTENNA

(75) Inventor: Hubert Diez, Leguevin (FR)

(73) Assignee: Centre National d'Etudes Spatiales, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/029,962

(22) PCT Filed: Jul. 9, 1997

(86) PCT No.: PCT/FR97/01243

§ 371 Date: Jul. 20, 1997

§ 102(e) Date: Jul. 20, 1997

(87) PCT Pub. No.: WO98/01920

PCT Pub. Date: Jan. 15, 1998

(30) Foreign Application Priority Data

Jul. 10, 1996 (FR) ..... 96 08601

(51) Int. Cl.[7] ..... H01Q 1/36

(52) U.S. Cl. ..... 343/895; 343/893; 343/897

(58) Field of Search ..... 343/895, 802, 343/792, 793, 850, 853, 857, 858, 859, 893, 897; H01Q 1/36

(56) References Cited

U.S. PATENT DOCUMENTS

| | | | | |
|---|---|---|---|---|
| 2,953,786 | | 9/1960 | Krause | 343/895 |
| 3,263,233 | | 7/1966 | Spitz | 343/895 |
| 5,134,422 | * | 7/1992 | Auriol | 343/895 |
| 5,859,621 | * | 1/1999 | Leisten | 343/895 |

FOREIGN PATENT DOCUMENTS

| | | | |
|---|---|---|---|
| 1441599 | 2/1969 | (DE) | H01Q/46/03 |
| 1541461 | 10/1969 | (DE) | H01Q/46/01 |
| 0 320 404 | 12/1988 | (EP) | G01Q/11/08 |

* cited by examiner

*Primary Examiner*—Tan Ho
*Assistant Examiner*—Shih-Chao Chen
(74) *Attorney, Agent, or Firm*—Blakely Sokoloff Taylor & Zafman

(57) ABSTRACT

The invention discloses a transmission device comprising an antenna having a plurality of aerial wires uniformly distributed regularly in a helix about a cylindrical generatrix, and means for feeding the aerial wires with a radio frequency signal. The invention is characterized in that the means for feeding produces an equi-phase and equi-amplitude signal which directly feeds the plurality of aerial wires.

10 Claims, 5 Drawing Sheets

TRANSMISSION DEVICE WITH OMNIDIRECTIONAL ANTENNA

FIELD OF THE INVENTION

The present invention relates to a transmission device with omnidirectional antenna.

The device proposed by the invention advantageously finds application in particular to transmission on terrestrial mobiles or on satellites.

BACKGROUND AND SUMMARY

One of the problems encountered in the operational implementation of a near-nondirectional aerial is the modification of its radiation diagram due to reflection effects (multiple paths).

Antennas with the purest possible circular polarization are customarily used to solve this type of problem.

An objective of the invention is to propose a device which allows at the same time pure circularly polarized transmission and omnidirectional coverage.

Numerous types of omnidirectional antennas are already known.

Mention may be made in particular of slot antennas arranged on cylinders, and more particularly two-cone antennas, as well as conical spiral antennas, or alternatively antennas of dipole type, for example those which have been described in the publications:

Brown and Woodward, "Circularly polarized omnidirectional antenna", R.C.A. Rev. June 1947;

K. Sakaguchi and N. Hasebe "Acriculary polarized omnidirectional antenna", IEEE Trans. on Antennas and propagation.

These various types of antennas allow toric radiation such as illustrated in FIG. 1, but do not allow the production of satisfactory circular polarization.

For its part, the invention proposes a novel type of transmission device with toric-radiation antenna exhibiting better polarization performance than the toric-radiation antennas of the prior art.

Helical antennas are known for their circularly polarized transmission properties.

In this regard, reference may advantageously be made to the publication:

Harold A. Wheeler "A helical Antenna for circular polarisation", Proceedings of I.R.E., December 1947.

An omnidirectional antenna with four helical aerial wires has already been proposed in U.S. Pat. No. 5,450,093. These various aerial wires are fed therein out of phase with one another.

However, the radiation diagrams of this type of antenna are still not fully satisfactory.

For its part, the invention proposes a transmission device whose antenna is of the type with helical aerial wires and which exhibits an improved transmission diagram as compared with that of an antenna of the type described in U.S. Pat. No. 5,450,093.

SUMMARY

More particularly, the transmission device proposed by the invention comprises an antenna having a plurality of aerial wires distributed regularly in a helix about one and the same cylindrical generatrix, as well as means for feeding the said aerial wires with a radiofrequency signal, and is characterized in that these feed means produce an equi-phase and equi-amplitude feed of the said aerial wires.

Advantageously, the feed means comprise a coaxial cable which runs coaxially inside the antenna and which feeds the various aerial wires of the latter in a bifilar manner.

Preferably, the coaxial cable common to the various aerial wires (which is of small size so as to avoid the stray reflections which would destroy the quality of the polarization) is protected by a ferrite sheath.

Other characteristics and advantages of the invention will emerge further from the description which follows. This description is purely illustrative and non-limiting. It should be read in conjunction with the appended drawings in which.

DETAILED DESCRIPTION

Figure 1:
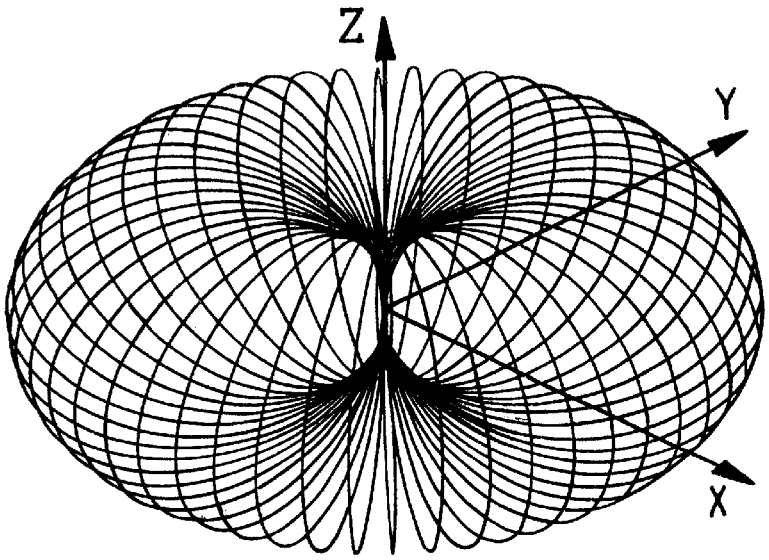
FIG. 1 illustrates a toric radiation, that is to say radiation such as sought by the invention.
Figure 2:
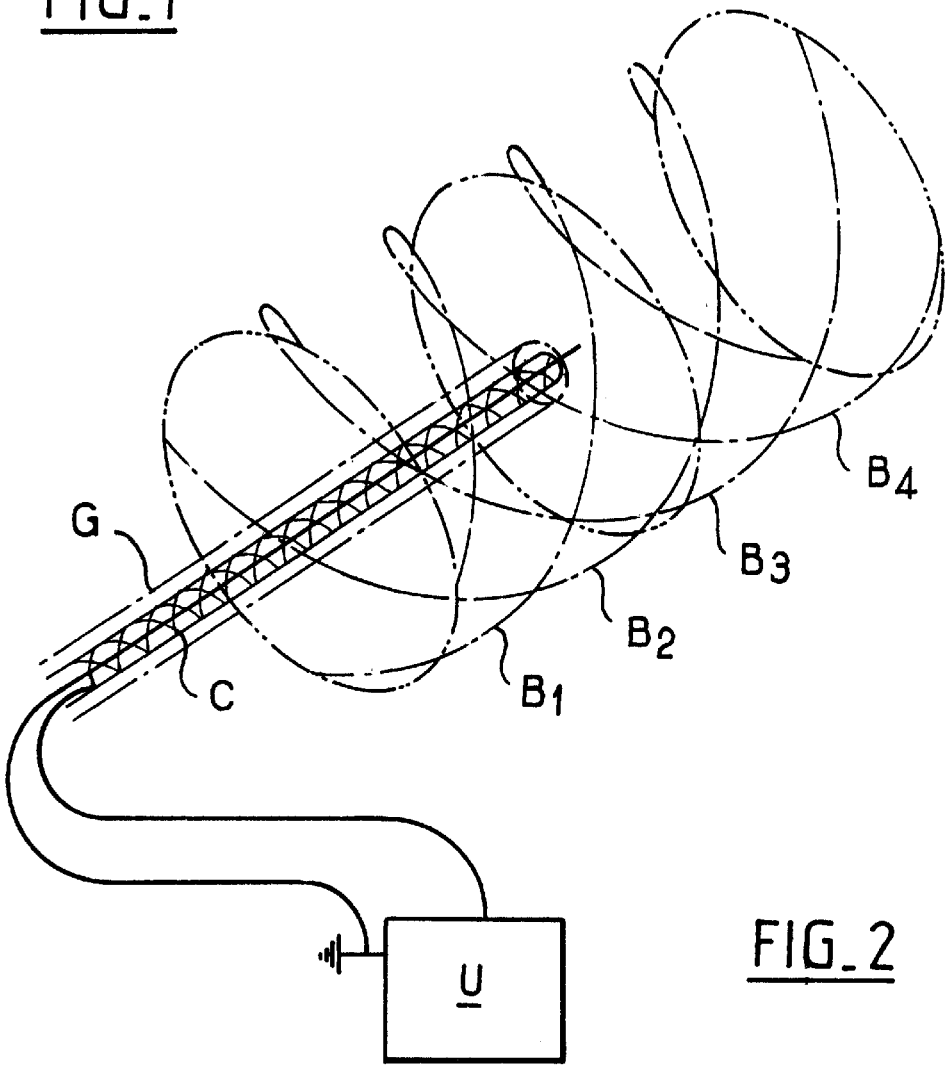
FIG. 2 is a perspective schematic representation of a device in accordance with one possible embodiment of the invention.

The antenna illustrated in FIG. 2 is an antenna with four helical aerial wires $B_1$ to $B_4$. The helices of these four aerial wires $B_1$ to $B_4$ are identical and offset by $\pi/2$ with respect to one another.

These four aerial wires are, for example, wires wound on a cylindrical mandrel made of a dielectric material.

Figure 4:
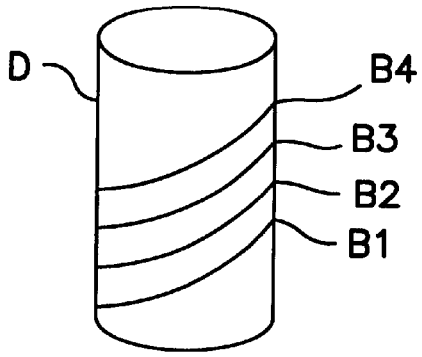
FIG. 4 illustrates an embodiment of an antenna of the present invention printed on dielectric support.

As a variant, it is possible to envisage making this antenna using printed technology, the aerial wires being printed on a dielectric support, D, as shown in FIG. 4.

In accordance with the invention, the antenna comprises means M for feeding these four aerial wires $B_1$ to $B_4$ in an equi-amplitude and equi-phase manner.

In the example described here, these feed means M comprise a coaxial cable C which runs partly inside the helices defined by the four aerial wires $B_1$ to $B_4$ and which makes it possible to convey a radio-frequency signal generated by a unit U to the said aerial wires.

At one of the ends of the antenna, the aerial wires $B_1$ to $B_4$ are linked to the ground of this coaxial cable C, while at their other end, these aerial wires $B_1$ to $B_4$ are linked to the outer braid of the coaxial C. The links between the ends of the aerial wires $B_1$ to $B_4$ and the coaxial cable C have not been represented so as not to overburden FIG. 2.

Of course, the invention is not limited to antennas with four radiating wires, but applies more generally to any antenna with n aerial wires. An even number of wires is however preferred.

This coaxial cable C is advantageously protected by a ferrite sheath G.

With such a configuration it is thus possible to preclude the ground of the coaxial cable from constituting a metal obstacle which disturbs the transmission.

As a variant, ferrite rings distributed every $\lambda/4$ over the length of the said cable can be provided on the coaxial cable C, where $\lambda$ is the wavelength of transmission.

Again as a variant, phase control means (a "balun" according to the terminology conventionally used by those skilled in the art) distributed every $\lambda/4$ over the wires $B_1$ to $B_4$ can be provided.

It will be noted that protection by a ferrite sheath is preferred on account of its simplicity of implementation, especially for ground uses.

Examples of directivity results are presented in the following table, for various antenna sizes and various input impedances.

These examples correspond to antennas with two one-turn helical wires.

The wires are 1 mm in diameter.

TABLE 1

| No. of turns | Axial height (m) | Radius of base (m) | Length of a wire ($\lambda$) | Zr | Zi | Directivity | $\alpha$ (Deg) |
|---|---|---|---|---|---|---|---|
| 1 | 0.085 | 0.024 | 1.154 | 59 | −230 | 2.8 dBi | 29.41 |
| 1 | 0.07 | 0.022 | 1.033 | 76 | −300 | 2.4 dBi | 26.86 |
| 1 | 0.067 | 0.0215 | 1.005 | 83 | −318 | 2.3 dBi | 26.38 |
| 1 | 0.062 | 0.021 | 0.972 | 144 | −369 | 1.3 dBi | 25.17 |
| 1 | 0.06 | 0.0205 | 0.947 | 101 | −365 | 2.1 dBi | 24.98 |
| 1 | 0.045 | 0.018 | 0.811 | 181 | −512 | 1.9 dBi | 21.7 |
| 1 | 0.04 | 0.017 | 0.76 | 222 | −568 | 1.8 dBi | 20.53 |
| 1 | 0.0375 | 0.0165 | 0.735 | 329 | −666 | 1.8 dBi | 19.89 |
| 1 | 0.03 | 0.015 | 0.659 | 605 | −840 | 1.7 dBi | 17.66 |
| 1 | 0.025 | 0.0135 | 0.59 | 1552 | 139 | 1.7 dBi | 16.42 |
| 1 | 0.0225 | 0.013 | 0.565 | 134 | 592 | 1.7 dBi | 15.4 |
| 1 | 0.016 | 0.011 | 0.473 | 149 | 390 | 1.7 dBi | 13.03 |
| 1 | 0.0105 | 0.009 | 0.383 | 24 | 93 | 1.7 dBi | 10.52 |

$\alpha$ represents the angle of progression of each helical wire, $Z_r$ and $Z_i$ the real and complex impedances at the input of the antenna (S.I. units).

As will be noted in this table, the directivity of such an antenna varies substantially from 1.7 dBi to 2.8 dBi.

It will also be noted that the length of a wire is preferably less than the wavelength $\lambda$. Beyond this, optimization is trickier, even though it is possible to obtain shaped diagrams.

The results presented in the above table were verified experimentally.

Figure 3:
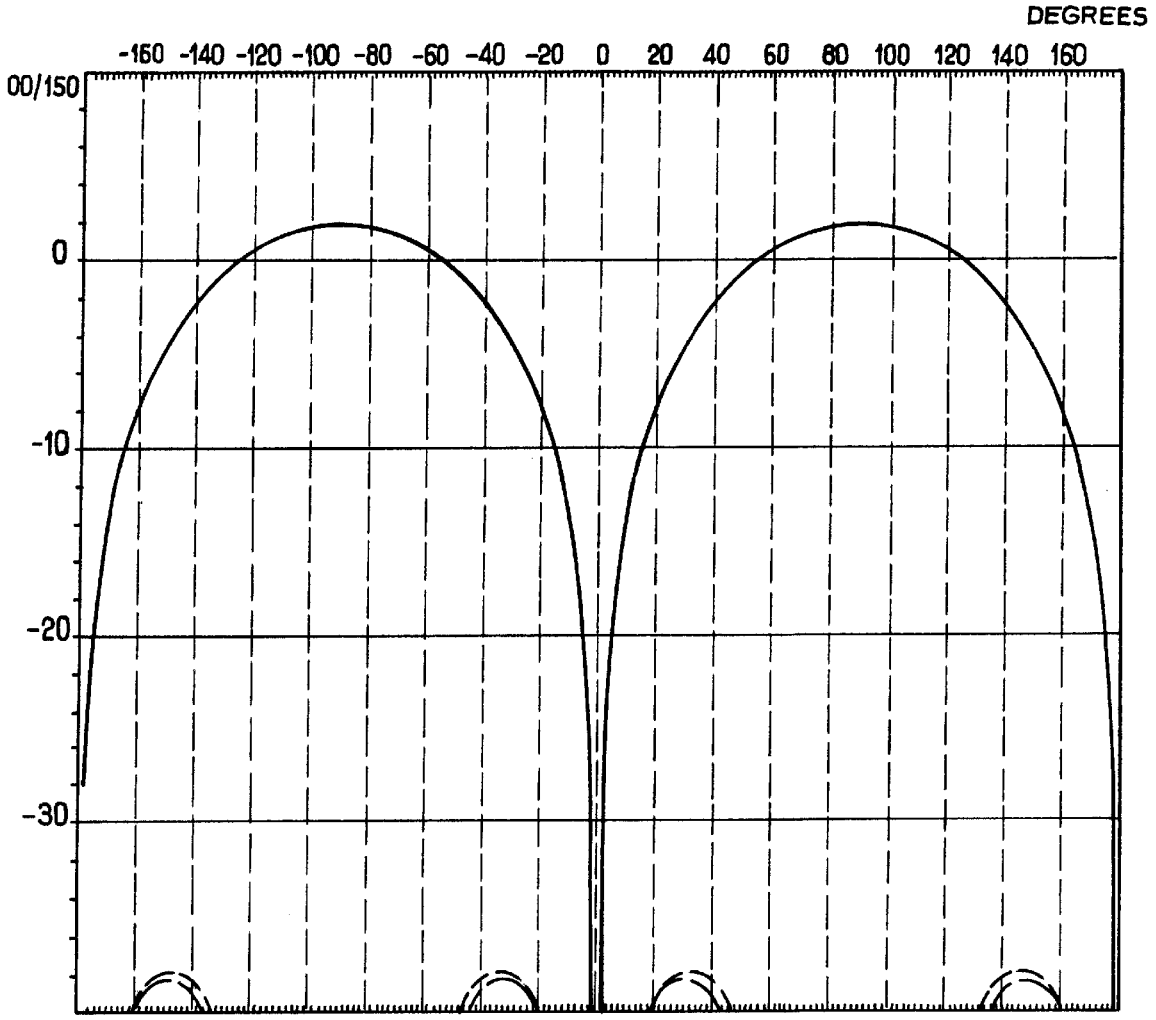
FIG. 3 illustrates an example of a radiation diagram obtained with the antenna of FIG. 2.

By way of illustration, FIG. 3 shows a plot of the angular radiation diagram obtained for an antenna axial height of 0.045 m, a base radius of 0.018 m and a ratio of the wire length to wavelength $\lambda$ of 0.811. The impedance was that indicated in the above table.

The transmission frequency was 2000 MHz.

This radiation diagram relates to a 9 m measurement sphere (far field).

The circular polarization obtained was of high quality.

It will be noted that the type of antenna which is proposed by the invention allows high compactness of geometry, whilst allowing near-omnidirectional coverage.

Moreover, the antenna just described is of low manufacturing cost.

It will also be noted that the compactness of the antenna just described makes it possible to envisage stacking several antennas of this type one above the other, for example on the same mandrel, all fed by the same coaxial cable, so as to increase the directivity of the aerial produced.

Figure 5:
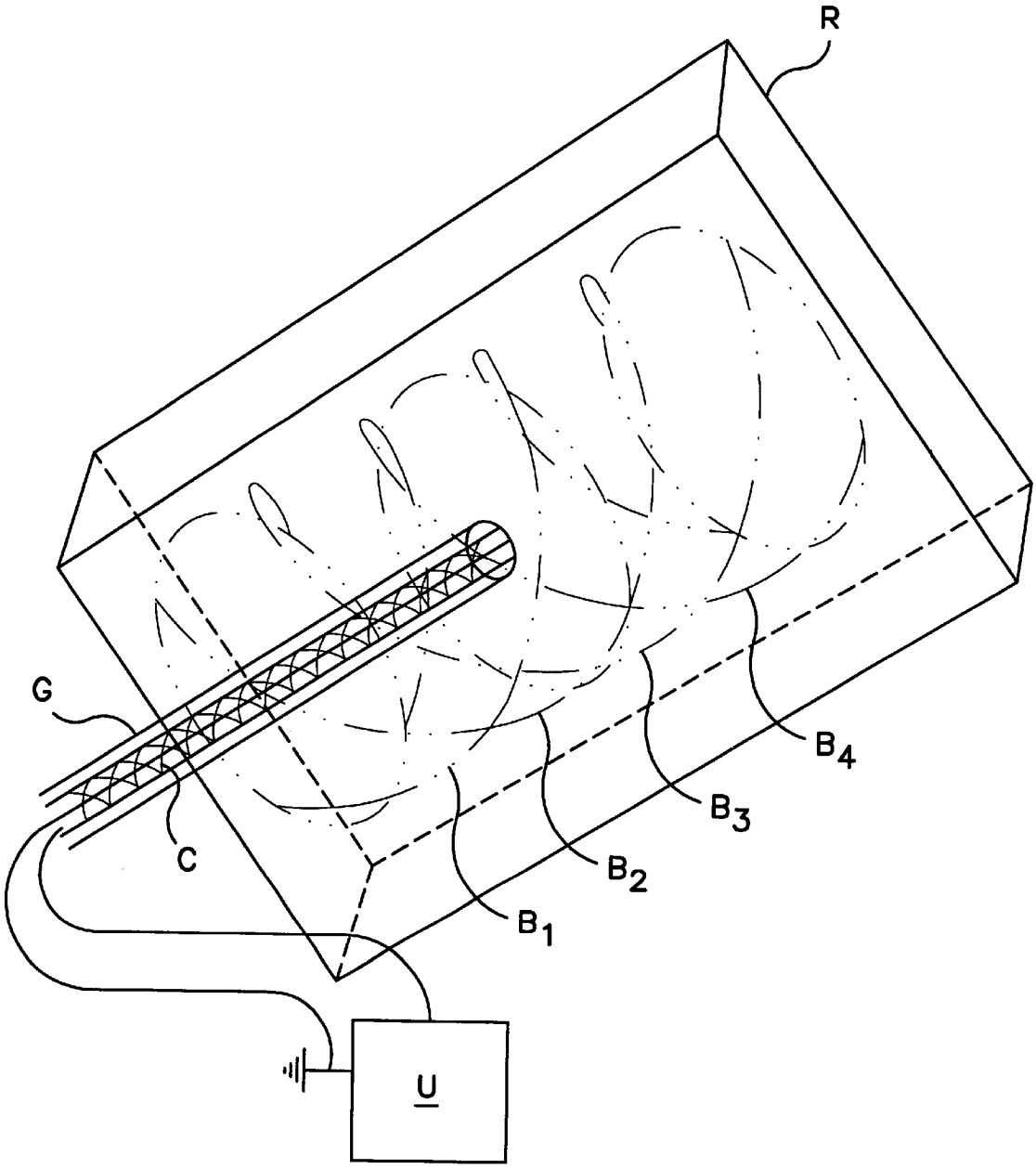
FIG. 5 illustrates an embodiment of an antenna of the present invention including a radioelectrically transparent radome.

Furthermore, the antenna may be advantageously protected by a radioelectrically transparent radome R, as shown in FIG. 5.

Figure 6:
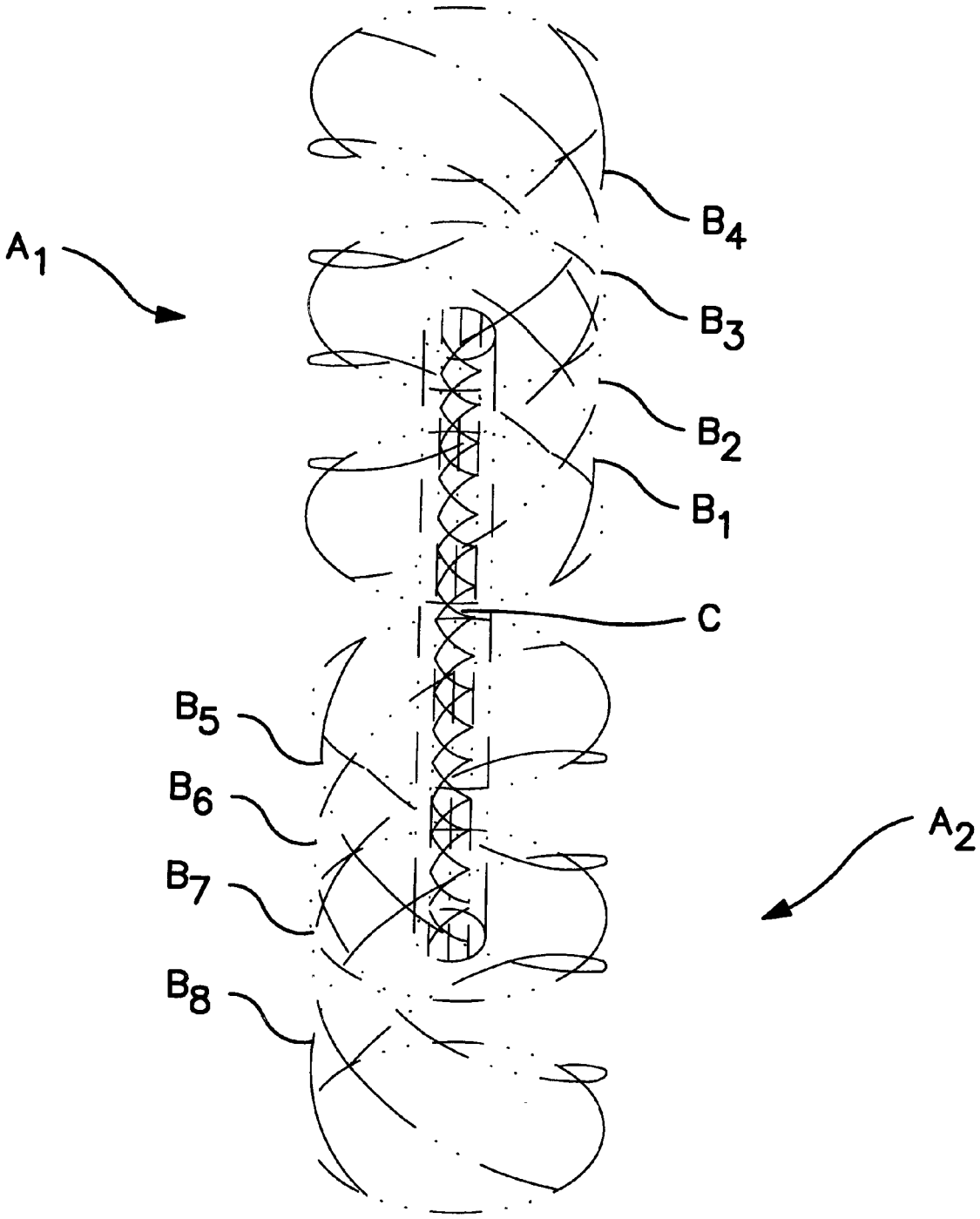
FIG. 6 illustrates an embodiment of an antenna of the present invention having a plurality of coaxially superimposed antennas.

For example, on the ground, the antenna can be fixed on a vehicle using a dielectric mast which optionally can be unfurled telescopically or alternatively consist of several elements nested together to form a plurality of coaxially superimposed antennas, $A_1$, having aerial wires $B_1$ to $B_4$, and $A_2$, $B_5$ to $B_8$, as shown in FIG. 6.

Figure 7:
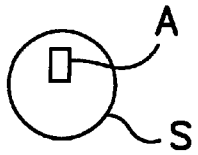
FIG. 7 illustrates an embodiment of an antenna of the present invention on a satellite.
Figure 8:
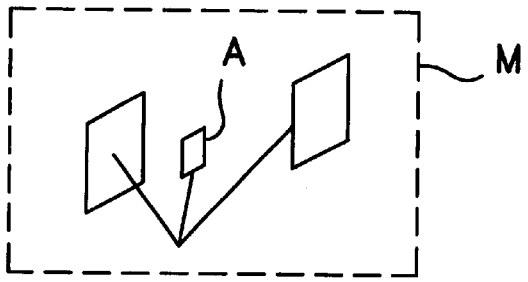
FIG. 8 illustrates an embodiment of an antenna of the present invention on a terrestrial mobile.

As will have been appreciated, the transmission device, antenna A, proposed by the invention is particularly adapted to all applications requiring omnidirectional transmissions and especially transmissions on spun mini satellites S navigating within a geocentric frame of reference, as shown in FIG. 7, or alternatively transmissions from a terrestrial mobile M, as shown in FIG. 8.

What is claimed is:

1. A transmission device comprising an antenna having a plurality of aerial wires ($B_1$ to $B_4$) to receive an equi-phase and equi-amplitude radio frequency signal, the aerial wires being distributed regularly in a helix about a cylindrical generatrix, and a means for feeding the aerial wires with the equi-phase and equi-amplitude radio frequency signal, wherein the means for feeding produces the equi-phase and equi-amplitude radio frequency signal which feeds the aerial wires.

2. The transmission device according to claim 1, characterized in that the means for feeding comprise a coaxial cable (C) which runs coaxially inside the antenna and which feeds the aerial wires ($B_1$ to $B_4$) in a bifilar manner.

3. The transmission device according to claim 2, characterized in that the coaxial cable is protected by a ferrite sheath (G).

4. The transmission device according to claim 1, characterized in that the aerial wires ($B_1$ to $B_4$) consist of wires wound on the same dielectric mandrel.

5. The transmission device according to claim 3, characterized in the aerial wires ($B_1$ to $B_4$) are conductors printed on a dielectric support.

6. The transmission device according to claim 1, characterized in that the antenna is protected by a radioelectrically transparent radome.

7. A transmission device comprising a plurality of coaxially superimposed antennae, each of the plurality of coaxially superimposed antennae having a plurality of aerial wires to receive in parallel an equi-phase and equi-amplitude radio frequency signal, the plurality of aerial wires being distributed regularly in a helix about a cylindrical generatrix, and means for feeding the aerial wires of each antenna with the radio frequency signal in parallel in an equi-phase and equi-amplitude manner.

8. The transmission device according to claim 1, characterized in that the length of at least one of the aerial wires is less than the transmission wavelength.

9. The transmission device according to claim 1 wherein the transmission device is attached to a terrestrial mobile.

10. The transmission device according to claim 1 wherein the transmission device is attached to a satellite.

* * * * *